United States Patent [19]

Walls

[11] Patent Number: 5,061,215

[45] Date of Patent: Oct. 29, 1991

[54] RIVER RAFT

[76] Inventor: H. Wayne Walls, P.O. Box 222, Pagosa Springs, Colo. 81147

[21] Appl. No.: 322,292

[22] Filed: Mar. 13, 1989

[51] Int. Cl.[5] ..... B63B 35/613

[52] U.S. Cl. ..... 441/45; 114/61; 114/201 R; 114/357; 114/363; 440/104

[58] Field of Search ..... 114/61 X, 357 X, 363 X, 114/201 R, 343, 267; 440/104 X, 105; 441/44, 45, 65, 74

[56] References Cited

U.S. PATENT DOCUMENTS

| | | | |
|---|---|---|---|
| 1,093,475 | 4/1914 | Rosins | 114/61 X |
| 1,762,451 | 6/1930 | Murphy | 441/405 X |
| 2,748,740 | 6/1956 | Villar | 114/61 |
| 3,179,076 | 4/1965 | Sheffield | 114/267 |
| 3,383,720 | 5/1968 | Greig et al. | 114/357 |
| 3,595,125 | 7/1971 | Jacobs | 410/106 |
| 3,628,204 | 12/1971 | Hoffman, Jr. | 114/343 |
| 4,068,611 | 1/1978 | Leather | 440/105 |
| 4,094,027 | 6/1978 | Vernon | 114/357 |
| 4,194,458 | 3/1980 | Messing | 114/363 X |
| 4,406,239 | 9/1983 | Euzmann | 114/61 X |
| 4,457,729 | 7/1984 | Peerlkamp | 441/74 |
| 4,503,799 | 3/1985 | Masters | 114/363 |
| 4,543,898 | 10/1985 | Castilla | 114/61 X |
| 4,569,301 | 2/1986 | Pyburn | 114/61 |

*Primary Examiner*—Sherman Basinger
*Attorney, Agent, or Firm*—Harrison & Egbert

[57] ABSTRACT

A river raft comprising a first solid pontoon having a hollow interior and a second solid pontoon also having a hollow interior. The first and second pontoons are connected together in a manner so as to define a central portion between the pontoons. The central portion has a depth of less than that of the first and second pontoons. Hatches are formed through the first end second pontoons so as to provide access to the hollow interiors. These hatches are detachably mounted to the upper surface of the pontoons. The first and second pontoons are of a symmetrical configuration. A spar tube connects these symmetrical configurations of pontoons such that the pontoons are maintained in fixed juxtaposition against one another. The first and second pontoons are made of a roto-molded plastic material. The central portion of the raft includes a plurality of openings extending therethrough. These openings are suitable for the receipt of ice chests, water bottles, and other items.

15 Claims, 4 Drawing Sheets

RIVER RAFT

TECHNICAL FIELD

The present invention relates to vehicles for travel on water. More particularly, the present invention relates to catamarans and river rafts. More specifically, the present invention relates to rafts of pontoon configuration.

BACKGROUND ART

In 1954, George E. White and Harry Aleson lacked a boat, but not the determination, for running the Colorado River through the Grand Canyon. They decided to not let a small problem like that stop them, and so they strapped on their life jackets and floated the lower canyons without a boat. Two years later, they were able to buy a military surplus raft and run the river that way.

Floating a river with only a life jacket is certainly one way to get an intimate feel of the river's currents, but it's difficult to carry gear and the idea doesn't appeal to everyone. Fortunately, big black neoprene rafts of the U.S. Navy became available as surplus after World War II. These rafts were extremely heavy and bulky to maneuver, but were also exceptionally tough and forgiving on the big volume, rocky rivers of the west.

The military assault rafts of World War II were still used occasionally .on rivers. They were made in seven-man and ten-man sizes and were constructed of neoprene-canvas. A surplus raft design featured a pointed, slightly raised bow and a flat, truncated stern. The main tubes were small, only about 15 inches, but their protruding spray shields worked fairly well in keeping water out of the raft.

The surplus rafts of World War II sufficed as river boats for some time, but commercial outfitters getting into the rafting business decided that they needed a raft with a slightly larger payload than that of the ten-man. The result was a model known as the "Green River", designed by Grand Canyon outfitter Ron Smith and Rubber Fabricators Company manager Del Mosser. The Green River had several advantages over the ten-man surplus raft. Instead of heavy canvas, it was built with lighter weight nylon, and its overall design was a blunt-nosed symmetrical shape, with a slight uplift at each end. It also had larger tubes and more inflation compartments than the surplus model.

Refinements in river rafts continued. Hypalon was developed as a more durable coating than neoprene. Designs also improved, with bow and stern lift becoming more pronounced. Chafing strips were added to the top and bottom of the raft to protect against rubbing of the rowing frame and abrasion from rocks and river beds. Developments in raft materials and design continued further. Polyester and Kevlar (TM) are the most recently used fabrics, and the newest coatings include polyvinyl chloride (PVC) and polyurethane. These improvements in materials have led to more sophisticated designs, including boat rigidity and tighter floors.

One of the more novel raft designs to hit the river has been patterned after the catamaran. Adapted to river running, this design consists of inflatable tubes used either in pairs with an open center or lashed together to form a mattress-like platform. The tubes of the catamaran raft may be of two different types, either "sausage" tubes or the upward-pointing "J"-tubes. For years, several commercial outfitters on the Colorado River, and especially in the Grand Canyon, have used the "J"-tube model, with lengths ranging from 21 to 33 feet, while the smaller sausage-tube is used commercially on both the California and Oregon Rivers.

Two smaller catamaran rafts, sometimes known in the West as the Cataraft and the Huck Finn, are excellent for the private river runner. The spider-like Cataraft uses two tubes connected with a frame, but with the center open. The Huck Finn, reminiscent of Mark Twain's legendary character, is assembled by lashing four tubes closely together with a metal rowing frame and nylon webbing straps. Any size tubes may be used, but the most common are those ranging from 13–15 feet.

Both the Huck Finn and the Cataraft offer several advantages over conventional rafts. The foremost advantage, of course, is the self-bailing feature, which prevents the raft from becoming filled with water and possibly "wrapping" around a boulder. Because the rafts eliminate the need for bailing and are impossible to swamp, they offer greater safety. Unlike other rafts, they cannot be filled with great quantities of water and rendered sluggish.

The Cataraft is a sport raft, as it gives a fast, thrilling ride. This raft is especially ideal for rocky rivers, where the chance of hitting rocks is reduced 50% because the Cataraft straddles them. When penned against a rock or Canyon wall, the upstream tube of traditional raft may be forced under water. The Cataraft, however, allows the water to pour through its open center without causing an upset. To free the Cataraft when stuck broadside on a rock, the boater can work in the center space, which is much safer than going over the side as required with other rafts.

With the great amount of floation it provides the Huck Finn is capable of heavy loads. It also protects passengers from rock bruises which can occur in conventional rafts if someone is thrown on the floor and a rock passes underneath.

In the past, rafts have been made of coated fabrics. The base fiber provides the material's strength and resistance to tearing, while the coating provides airtightness and abrasion resistance. Cotton canvas was used as the base fiber in World War II assault rafts, but it was soon replaced by nylon. Nylon is still the most popular fabric, but polyester and Kevlar (TM) are increasingly used for their strength and stiffness. As for coatings, neoprene was the standard for many years, but has recently been displaced by the more durable, and also more expensive, Hypalon, a product of DuPont. Newer coatings have also appeared, including polyvinyl chloride (PVC) and polyurethane. The typical combinations of base fibers and coatings include: nylon/neoprene, nylon/Hypalon, polyester/PVC, and Kevlar (TM)/polyurethane. The technology of material used in rafts has been improving throughout the years. As with all materials, the various materials used on rafts are subject to various quality and cost considerations.

For commercial river runners, it is important that the consumer be afforded an enjoyable, yet safe, ride. Commercial river runners have found that the ride is most enjoyable when a great deal of spray occurs and when the ride is very fast. Times of sluggish movement through the water offer an uninresting ride for the passenger. Additionally, the efforts required to oar the boat through sluggish water are a tremendous burden on the oarsman. As such, it is desirable to have the raft perform quickly in fast water and be suitable for more streamlined movement in slow water.

Given the high levels of insurance for those operating river running services, it is also very desirable to offer a safe ride to the passenger. As such, it is desirable to build a raft that is very safe and difficult to capsize. To succeed in the river running business, the river runner, in the past, has had to balance the considerations of safety against those of providing thrilling rides.

Additional considerations facing the commercial river runner relate to the durability and cost of the rafts. Any flexible raft may be subject to tearing, ripping, or deflating. Despite the strength of the materials used for the commercial rafts, there is seldom the complete assurance that no disasters will occur. For those passengers, it is a horrible experience when the raft becomes deflated or unsuitable for further use. The passengers must crowd onto another raft, or be delayed while a replacement raft arrives. In addition, the destruction of a single raft can have devastating financial effects on the commercial river runner. As such, it is desirable that the river raft be relatively inexpensive yet extremely durable.

It is an object of the present invention to provide a river raft that is very stable in water.

It is another object of the present invention to provide a river raft that moves quickly in water and is easily maneuverable.

It is still another object of the present invention to provide a river raft that is relatively inexpensive.

It is still another object of the present invention to provide a river raft that incorporates features of cargo capacity, stowability, and creature comforts.

These and other objects and advantages of the present invention will become apparent from a reading of the attached specification and appended claims.

SUMMARY OF THE INVENTION

The present invention is a river raft that comprises a first solid pontoon having a hollow interior and a second solid pontoon having a hollow interior. The first pontoon is connected to the second pontoon in a manner so as to define a central portion between the first and the second pontoon. The central portion has a depth less than that of the first and second pontoons.

The first and second pontoons each have hatches formed therein so as to provide access to the hollow interiors of these pontoons. The hatches are detachably mounted to the upper surface of each of the pontoons away from the water's edge. The hatches are mounted in water-tight relation to the first and second pontoons so that water, from a river, cannot penetrate into the hollow interior of the pontoons.

In particular, the hatches include a seat hatch that is detachably mounted to one of the pontoons. The seat hatch has a saddle extending upwardly from the hatch panel. The saddle of the seat hatch also has a removable cover that allows one to have access to the interior of the saddle itself. This seat hatch is reversible such that the saddle may be received by the hollow interior of the pontoon. An oar stand hatch is also provided on the pontoons. The oar stand hatch has an oar stand that is fixed to the top of the hatch panel. The oar stand is of a type suitable for receiving an oar. The oar stand hatch is also reversible such that the oar stand may be received by the hollow interior of the pontoon.

The first and second pontoons are of symmetrical configuration such that a single mold can be used to build the entire raft. A spar tube extends through the width of these pontoons so as to connect these pontoons together. In particular, the spar tube configuration includes a tubular opening that extends through the pontoons, a spar tube that is fitted within the tubular opening and extends across the raft, and a spar cap that connects to the threaded ends of the spar tube. The tightening of the spar cap draws the first and second pontoons together such that the pontoons are maintained in close juxtaposition to each other.

The first and second pontoons are generally made of a roto-molded plastic material. In particular, the configuration of the body of the pontoons is made up of an outer layer of a solid dense plastic material, a middle layer of a foamed plastic material, and an inner layer of a solid dense plastic material. The middle layer is integrally interposed between the outer layer and the inner layer.

The central portion of the raft has a rectangular bevelled opening that extends through the depth of the central portion. This bevelled opening narrows at the bottom of the central portion. This bevelled rectangular opening is suitable for the receipt of an ice chest. When in position, the bottom of the ice chest will extend to the bottom of the central portion so as to be exposed to the river's water for cooling purposes.

Additionally, the central portion has a first circular opening that extends through the top surface of the central portion. A second circular indentation, concentric with, and of lesser diameter than the first circular opening, is formed at a greater depth through the central portion. A third circular opening extends through the bottom of the central portion so as to act as a drain hole for this recessed area. In particular, the recessed area defined by these circular openings is for the receipt of water coolers of various sizes.

Foot indentations are formed within this central portion. Generally, these foot indentations are formed adjacent the rectangular openings for the ice chest. As such, the oarsman can sit on the ice chest while maintaining his feet in proper position within the foot indentations. The foot indentations are bevelled at the ends at a twenty degree angle from the vertical. Each of the foot indentations includes a drain hole that opens to the bottom of the central portion.

A plurality of tie-down openings are formed in the top surface of the central portion. These tie-down openings are bevelled such that the narrow portion of the opening is adjacent to the top surface of the central portion. The central portion also has a cross-hatched end section and a cross-hatched forward section for the receipt of trampolines.

Around the periphery of the pontoons is a spray deflector. This spray deflector is integrally formed with the first and second pontoons and extends around the pontoons. A plurality of hand grip openings are formed through the spray deflector to aid in the mobility of the river raft of the present invention.

DETAILED DESCRIPTION OF THE INVENTION

Figure 1:
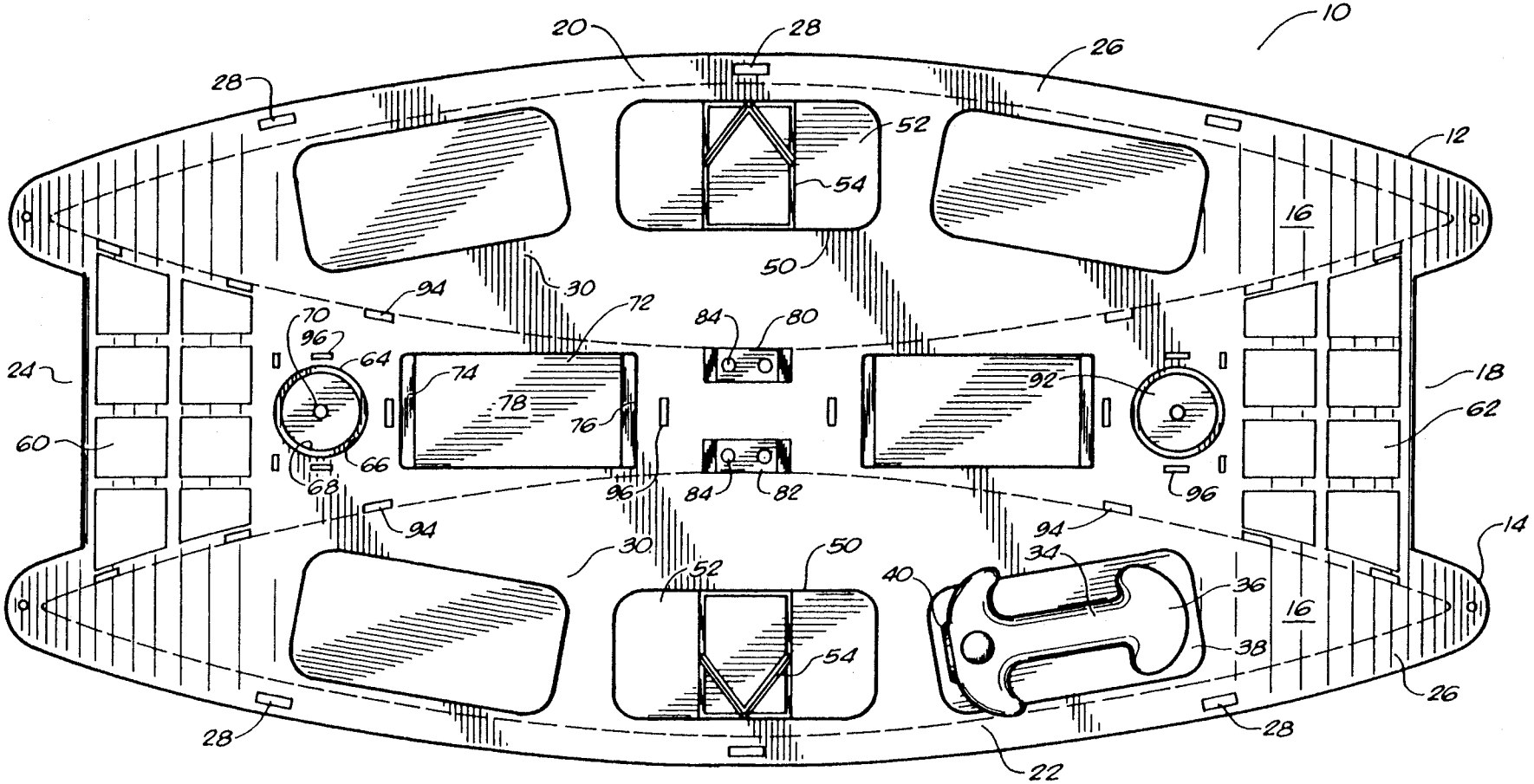
FIG. 1 is a plan view of the river raft in accordance with the preferred embodiment of the present invention.

Referring to FIG. 1, there is shown at 10 a plan view of the river raft of the present invention. River raft 10 comprises a first pontoon 12 and a second pontoon 14. Both first pontoon 12 and second pontoon 14 have solid shells and hollow interiors 16. Pontoons 12 and 14 are connected together so as to form central portion 18. The central portion 18 is a flat surface midship of the raft 10. Although not shown in FIGURE the central portion 18 has a depth less than that of the depth of the first pontoon 12 and the second pontoon 14.

First pontoon 12 has a generally eliptical configuration along wall 20. Similarly, second pontoon 14 has an eliptical wall 22 forming the outside surface of raft 10. At the other side of walls 20 and 22, a flat extending portion 24 is formed. Each of pontoons 20 and 22 shown as flat area 24, that defines the central portion of raft 10. As can be seen in FIG. 1, pontoons 20 and 22 are symmetrical. Since pontoons 20 and 22 are symmetrical, they may be made from the same mold. These pontoons 20 and 22 are then joined together in the manner illustrated in FIG. 1. A spray deflector 26 is integrally formed with the first pontoon 20 and the second pontoon 22. The spray deflector extends around the periphery of the first pontoon 12 and the second pontoon 14. Spray deflector 26 has a plurality of hand grip openings 28 that are formed therein.

Figure 6:
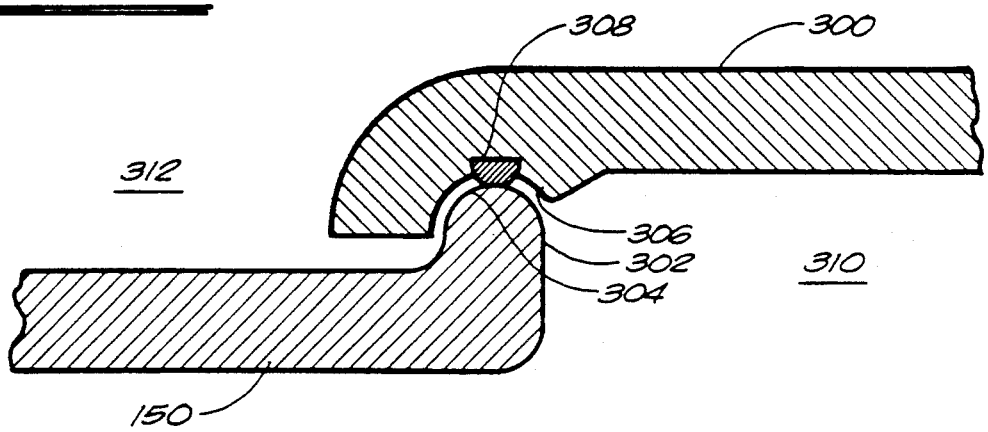
FIG. 6 is a detailed view of the hatch seal of the present invention.

A plurality of hatches 30 are formed in the first pontoon 12 and the second pontoon 14 so as to provide access to the hollow interior of the first pontoon 12 and the second pontoon 14. Each of the hatches 30 are detachably mounted to the upper surface of each of the pontoons. In particular, hatches 30 are mounted in water-tight relation to first pontoon 12 and second pontoon 14. The detail of the manner in which the hatches are received by the pontoon are illustrated in FIG. 6.

In particular, it can be seen that a seat hatch 34 is detachably mounted to second pontoon 14. Seat hatch 34 comprises a saddle 36 that extends upwardly from hatch panel 38. Saddle 36 allows passengers to sit thereon. Additionally, saddle 36, as will be described hereinafter, has a configuration suitable for maintaining the passenger in a seated position on the raft 10, rather than being thrown into the water in rough conditions. The hatch panel 38 may be bolted, or otherwise attached, to the receiving area of second pontoon 14. As will be shown hereinafter, the seat hatch 34 is reversible such that the saddle 36 may be received by the hollow interior of the second pontoon 14. It should also be noted that the seat hatch 34 may also be attached to the first pontoon 12 and received in the same manner. All of the hatches 30 of the present invention are interchangable as required. It can be seen in FIG. 1 that the saddle 36 includes a removable cover 40 that is threadedly connected to the forward portion of saddle 36. Removable cover 40 permits access to the interior of the saddle 36 for additional storage capacity.

On each of pontoons 12 and 14 is an oar stand hatch 50. The oar stand hatch 50 is mounted to the top surface of each of the pontoons 12 and 14. In particular, oar stand hatch 50 includes hatch panels 52 and the oar stand 54. Oar stand 54 is fixedly attached to the top of hatch panel 52 Hatch panel 52 is attached by bolting, or other means, in proper position upon the pontoons 12 and 14. The oar stands 54 are of conventional configuration for receiving oars (not shown). The oar stand hatch 50 is also reversible such that the oar stand 54 may be received within the hollow interior 16 of the pontoons 12 and 14.

With reference to the hatches 30, the ability to reverse the seat hatch 34 and the oar stand hatch 50 allows these hatches to be reversed such that the saddle 36 and the oar stand 54 are received within the hollow interior 16 of the pontoons. As such, when in the stowed configuration, the river raft 10 is more easily stacked, stored, and transported. There is no risk of damage to the oar stand 54 by accidental jarring nor is there any chance of scarring or nicking of the saddle 36 from the transport of the river raft 10. This configuration greatly adds to the life of these components of the raft.

In the plan view of FIG. 1, it can be seen that the central portion 18 has a cross-hatched end section 60 and a cross-hatched forward section 62. The cross-hatching of end section 60 and forward section 62 is accomplished during the molding of the pontoons 12 and 14. Cross-hatched sections 60 and 62 are positioned for the receipt of a standard raft trampoline thereon. The cross-hatching opens to the water below the raft and decreases the weight of the central section 18. In particular, in FIG. 1, there are eight cross-hatched openings 60 in the end section, and eight cross-hatched openings in the forward section 62.

Adjacent to the cross-hatched section section 60 and 62 is a circular indentation 64. As can be seen, circular indentation 64 includes a first indentation 66, a second circular indentation 68, and a third circular hole 70. The first circular indentation 66 defines the outer diameter of the indentation 64. In particular, the size of first circular indentation 66 is suitable for the receipt of a five-gallon Gott water cooler. The second indentation 68 is concentric with the first indentation 66 and is suitable for receiving a three-gallon Gott water cooler. Hole 70 is formed in the middle of the circular indentation 64 as used in the drain hole. Hole 70 will open to the bottom of the central portion 18 and, thusly, open to the water below raft 10. A rectangular opening 72 is formed on central portion 18 for the receipt of ice chests. In particular, rectangular opening 72 has bevelled ends 74 and 76. Rectangular opening 72 has bevelled ends 74 and 76 so as to receive the bevelled bottom portions of an ice chest inserted thereinto. Area 78 opens to the bottom of central portion 18. As such, any ice chest that is fitted within rectangular opening 72 has its bottom portion exposed to the water running beneath raft 10.

A pair of foot indentations 80 and 82 are also formed in the middle of central portion 18. These foot indentations should have a size sufficient to accommodate the feet of an oarsman of raft 10. The foot indentations 80 and 82 include drain holes 84 which open to the bottom of central portion 18 and to the water beneath raft 10. The foot indentations 80 and 82 are positioned such that the oarsman may sit on the ice chest fitted within opening 72. The foot indentations 80 and 82 assist the oarsman in having leverage over the oars and in maintaining his balance while directing the raft down rapid water.

Insofar as the river raft 10 is symmetrical, it can be seen that a second rectangular opening 90, and a second circular indentation 92 are formed on the other side of foot indentations 80 and 82 on raft 10. These have the same configuration as circular indentation 64 and rectangular opening 72. Since the raft 10 is symmetrical, the oarsman may be seated in either direction and the raft may be directed in either direction. Also, since the raft 10 is symmetrical, it is not necessary to turn the raft around in certain situations. It may be easier to simply change positions within the central portion 18 of the raft 10.

A plurality of water drain holes 94 are placed about the central portion 18 of raft 10. Water drain holes 94 allow water to drain from the central portion 18 into the water running beneath the raft. These water drain holes are positioned closely adjacent the inner walls of the pontoons 12 and 14. Also, a plurality of tie-down holes 96 are arranged about the central portion 18. These tie-down holes receive quick-release straps having Canam buckles. These tie-down holes 96 are approximately five inches deep. As well be described hereinafter, each of these tie-down holes 96 has a bevelled surface so as to properly receive the Canam buckles. The tie-down holes 96 may be used to strap in the ice chests, the water coolers, and other accessories onboard the raft 10.

Figure 2:
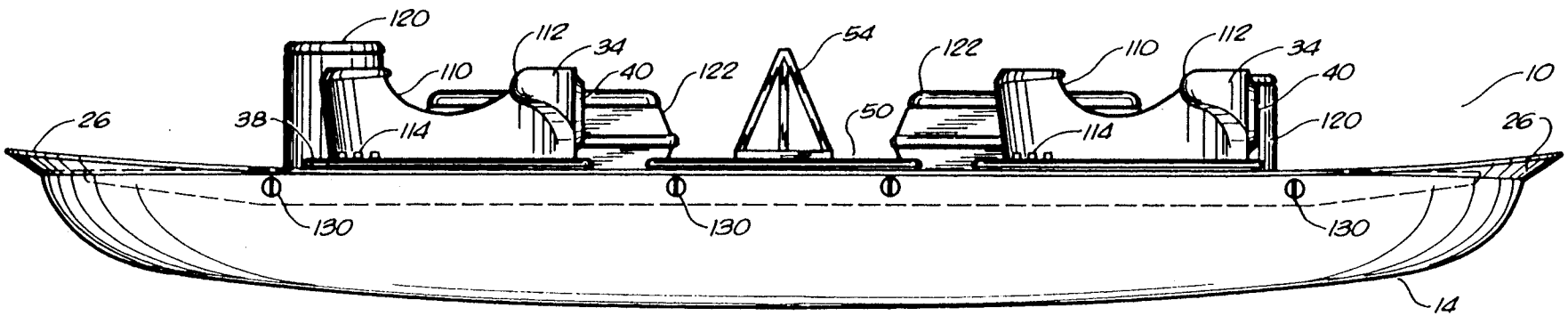
FIG. 2 is a side elevation view of the river raft of the present invention.

FIG. 2 shows a side elevational view of river raft 10. In particular, in FIG. 2, the outer walls of the second pontoon 14 are shown. The spray deflector 26 is arranged around the periphery and the top of pontoon 14. In particular, it can be seen that spray deflector 26 extends outwardly beyond the wall of pontoon 14 a small distance. Additionally, in FIG. 2, the saddles 34 as mounted to the top surface of the central portion 18 are illustrated. Saddles 34 are a stylized form of saddle that is presently manufactured by Perception Kayak of Easley, S.C. The saddles 34 bolt into position on the respective hatches. As can be seen, the saddles 34 have a sitting portion 110 which accommodates the passenger of the raft 10. In particular, the seating area 110 has a generally semi-cylindrical shape. The inwardly turned portion 112 of saddle 34 is used to accommodate the knee of the raft passenger. Also, a plurality of wooden extensions 114 are formed on the bottom hatch plate 38 so as to accommodate the toes of the passenger. In other words, the wooden projections 114 are used so that the passenger may exert pressure thereon and maintain his position on saddle 34. The cover 40 is also shown with particularity in FIG. 2. Cover 40 is threadedly connected to the forward section of saddle 34. By unscrewing the cover 40, access to the interior of saddle 34 is achieved. FIG. 2 further illustrates the arrangement of the water cooler 120 and ice chests 122. The oar stand hatch 50 is mounted between each of the saddles on pontoon 14. The oar stand 54 is arranged so as to receive the proper accessories of an oar.

Of particular interest, as illustrated in FIG. 2 are the spar caps 130. Spar caps 130 are illustrated, with particularity, in FIG. 8. In particular, the spar caps 130 are threaded members that attach to a spar tube that runs through the interior and the width of pontoons 12 and 14. By tightening the spar caps 130, the pontoons 12 and 14 are joined together in a rather rigid configuration. This joining is accomplished by tightening the spar cap upon the threaded spar tube and exerting pressure on the angled walls of the spar cap opening adjacent to spar caps 130.

Figure 3:
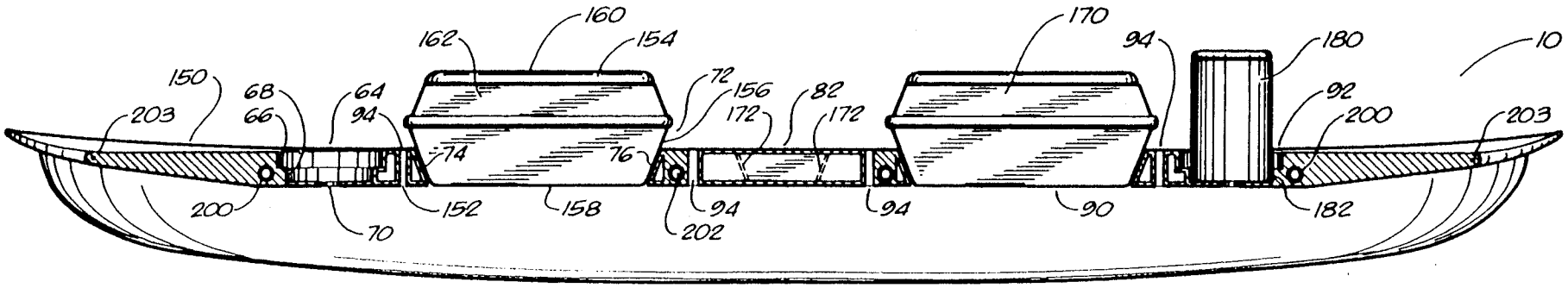
FIG. 3 is a cross-sectional view of the river raft of the present invention.

FIG. 3 illustrates a cross-sectional view of the raft 10. In particular, in this cross-sectional view, the configurations of the circular indentation 64, the rectangular opening 72, the foot indentation 82, and the drain holes 94 can be seen. Initially, the circular indentation 64 is formed through the surface 150 of the central portion 18. The largest circular indentation 66 is formed of lesser depth than the second indentation 68. The first circular indentation 66 is used to receive the five-gallon water cooler. The second, smaller diameter indentation 68 is used to receive a three-gallon water cooler. As such, this circular area 64 is suitable for receiving a variety of different water coolers and is adaptable for many purposes. A drain hole 70 is formed centrally of the circular indentation so as to allow any water within the circular indentation 64 to drain from the raft.

The drain hole 94 extends through the depth of the central portion 18 so as to allow water to pass from the top surface 150 through the opening of drain hole 94 and outwardly through the bottom 152 of the central portion 18 of raft 10.

Rectangular opening 72 accommodates a Gott 80 ice chest 154. Ice chest 154 has a bevelled side area 156 which is received by the bevelled ends 74 and 76 of the rectangular opening 72. The walls of the ice chest 154 and these bevelled ends 74 and 76 are matched in close juxtaposition. The bottom 158 of ice chest 154 opens to the bottom 152 of the central portion 18. In operation, as water runs beneath the raft 10, any splashing will impinge the bottom 158 of ice chest 154 so as to add additional cooling to the ice chest 154. The oarsman of the raft 10 may sit on the top 160 of ice chest 154. As such, the top panel 162 of ice chest 154 should have sufficient strength to withstand the weight of the oarsman.

The foot indentation 82 is placed between ice chest 154 and ice chest 170. Ice chest 170 may also be used to accommodate the oarsman. Ice chest 170 has a similar configuration as that of ice chest 154 and is received by the rectangular indentation 90 in the same manner as ice chest 154 is received by the indentation 72. As stated previously, the raft of the present invention is symmetrical. Importantly, it can be seen that the foot indentation 82 includes twenty degree bevelled angled portions 172 extending through the depth of the central portion 18. These bevelled portions 172 are angled at twenty degrees from the vertical. A plate 174 may be placed at the bottom of the foot indentation 82. The angled portions of the bevelled area 172 of foot indentation 82 are arranged so as to comfortably accommodate the feet of an oarsman. For additional leverage, the oarsman may desire to place his feet upon the bevelled surfaces 172 so as to gain additional leverage upon the oars.

It can also be seen that a smaller ice cooler 180 is received by the circular indentation 92 at the other end of raft 10. Water cooler 180 has a cylindrical shape that fits flush within the circular area 182 of circular indentation 92.

In FIG. 3, the configuration of the spar tube 200 of the present invention is shown. For the joining of the pontoons 12 and 14 together, a spar tube opening is molded through the width of the pontoons 12 and 14. In particular, this spar tube opening 200 is a tubular opening that is in alignment across both of the pontoons. During the molding process, a steel rod is utilized so as to form this tubular opening 200. A spar tube 202 is then fitted into the spar tube opening 200 so as to extend across the width of the raft 10. The spar tube is a rigid member having a diameter smaller than the inner diameter of the spar tube opening 200. For strength and stability it is desirable to keep the clearance between the spar tube opening 200 and the spar tube 202 as small as possible. After assembly, a spar cap is threadedly connected to the ends of the spar tubes so as to join the pontoons 12 and 14 together.

An alignment pin 203 is shown in FIG. 3 at the forward and rearward portions of the river raft 10. The alignment pin is provided so as to stabilize the structure of the river raft 10 at the forward and rearward portions of the river raft. The alignment pin 203 is located in the middle of the deck. Alignment pin 203 is a steel tube that fits into formed openings in the body of the river raft 10.

Figure 4:
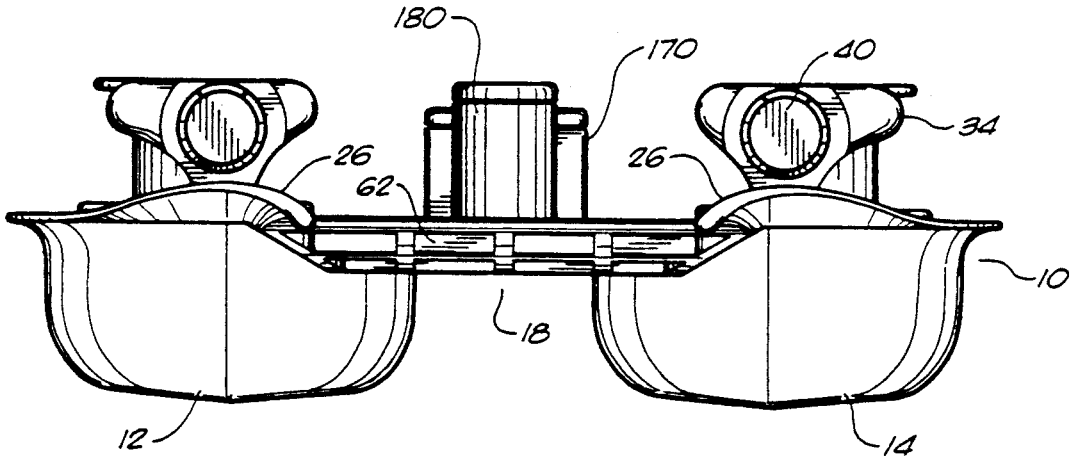
FIG. 4 is a front elevational view of the river raft of the present invention.

FIG. 4 is a frontal view of the raft 10 of the present invention. In FIG. 4, the shape of the seat hatch 34 is particularly illustrated. Also, the cover 40 which is threadedly connected to the saddle 34 is illustrated. Access to the interior of saddle 34 may be achieved by unscrewing the cover 40, in a manual fashion, from the saddle 34. As such, access to storage space may be maintained even during the rafting activity. The interior of saddle 34 may be utilized to receive the camera equipment of passengers, or other items.

As can be seen, the central portion 18 shows the arrangement of the cross-hatch end 62. It can be seen that the central portion 18 has a relatively narrow depth in comparison with the depth of pontoons 12 and 14. In operation, the water of the river will run between the pontoons 12 and 14. Further in FIG. 4, the water cooler 180 and the ice chest 170 are illustrated as received by the central portion 18 of raft 10. The arcuate shape of the spray deflector 26 is particularly illustrated. This arcuate shape of spray deflector 26 prevents a great portion of the waves from striking the passengers on board the raft 10.

Figure 5:
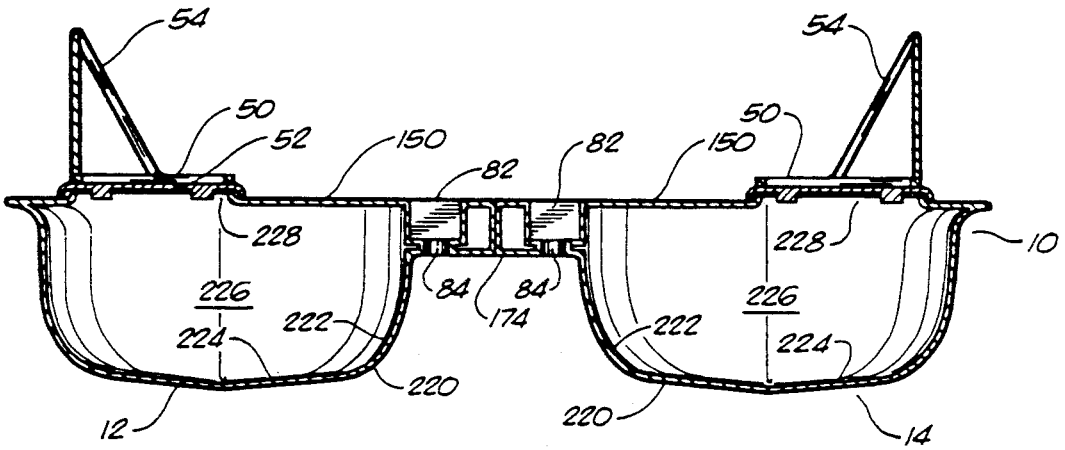
FIG. 5 is a frontal cross-sectional view of the river raft of the present invention.

FIG. 5 is a cross-sectional view of the raft 10 of the present invention. In particular, the shape of the material used for pontoons 12 and 14 is illustrated. Pontoons 12 and 14 are made of a roto-molded, multidump cross-linked polyethylene material. The roto-molding process allows the symmetrical shape of the pontoons 12 and 14 of the present invention to be achieved. Initially, the plastic is blown into the mold. The mold is then spun so that a heavy dense layer forms the skin (or outer layer) 220. The heavy dense outer layer 220 is adjacent a foam middle layer 222. The inner layer 224 is also formed of the solid dense plastic material of the outer layer 220. The inner layer 222 is integrally interposed between the outer layer 220 and the inner layer 224. It is important to maintain a heavy dense outer layer 220 to prevent damage to the pontoons 12 and 14 during river travel. It is also important to have a heavy dense inner layer 224 so as to prevent damage to the pontoons 12 and 14 from the stowage of gear within the hollow interior 226 of each of the pontoons. In operation, the hollow interior 226 may be used to receive gear, air bags, flotation equipment, and other vital items.

The oar stand hatch 50 is shown as received by the top surface 150 of the raft 10. The oar stand hatch 50 may be bolted or otherwise connected, in water-tight relation, about opening 228. When the raft is not in operation, the oar stand 54 may be inverted such that the stand is received by the hollow interior 226 of the pontoons 12 and 14. The bottom surface of the hatch plate 52 will then be facing upwardly and form the top surface of the stowed raft 10. In the preferred embodiment of the present invention, the oar stand hatch 50 is placed such that the bottom of the hatch abuts the spar tubes running through the raft. This abutment relationship provides greater stability for the oar stand hatch. The spar tubes will provide better support for the oar stand hatch and the stresses and forces placed upon the oar stand hatch by the rowing of the raft.

FIG. 5 also shows the configuration of the foot indentations 82. The foot indentations 82 have a width, as shown in FIG. 5, sufficient to accommodate the width of the feet of the oarsman of the raft 10. Drain holes 84 extend through the bottom 174 of the foot indentations 82. As such, when water finds its way into the foot indentations 82, the water immediately passes through the drain holes 84 and into the river water.

FIG. 6 illustrates a detailed view of the configuration of the hatch 300 in relation to the top surface 150 of raft 10. In particular, it can be seen that the top surface 150 has a curved upwardly extending portion 302 having a radius 304. Hatch 300, in turn, has a radius 306 that generally matches the radius 304. A gasket 308 is provided in radius 306 so as to abut the top edge of radius 304 of extension 302. When the hatch 300 is mounted, bolted, or otherwise attached to the top surface 150 of the pontoon, the gasket 308 will compress so as to seal, in water-tight fashion, the interior 310 from the outside environment 312.

Figure 7:
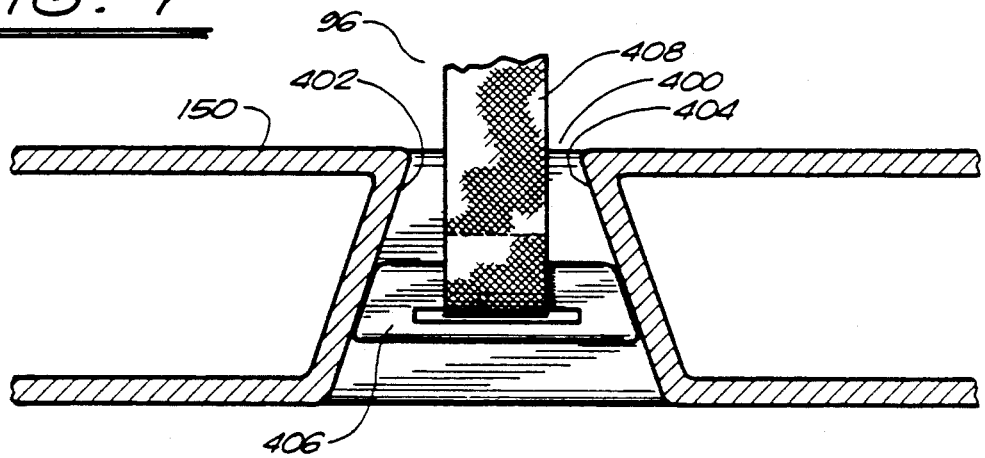
FIG. 7 is a detailed view of the tie down of the present invention.

FIG. 7 illustrates the tie-down 96. The tie-down opening 400 is formed into the top surface 150 of raft 10. The tie-down opening 400 has bevelled walls 402 and 404. These walls 402 and 404 are bevelled such that the narrow portion of the opening is adjacent to the top surface 150 of raft 10. The slotted wedge 406 is wedged between walls 402 and 404 so as to retain the slotted wedge 406 in the position illustrated in FIG. 6. Webbing 408 is wrapped around slotted wedge 406 so as to extend outwardly through opening 400. The webbing 408 can be connected to a Canam buckle for the benefit of the river raft user. Webbing 408 can then be used to tie down any materials onto the top surface 150 of raft 10 or to otherwise secure the water cooler or the ice chest as mounted onto the top surface of the raft.

Figure 8:
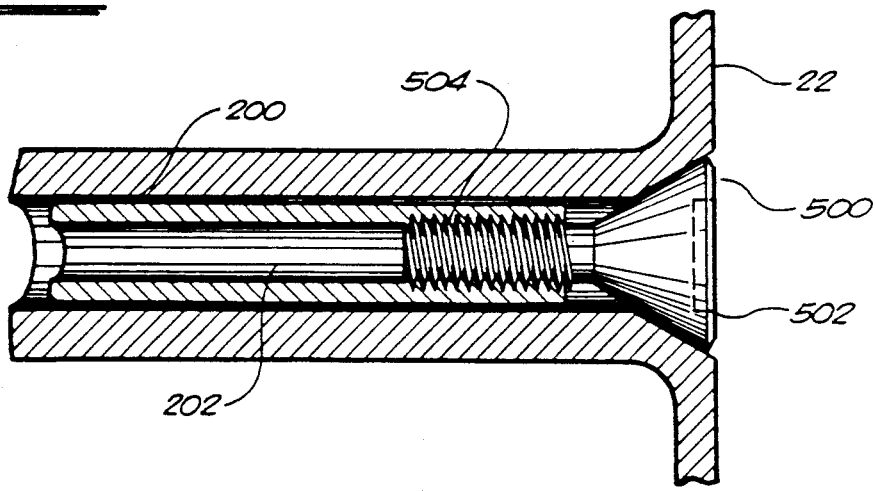
FIG. 8 is a cross-sectional view, in detail, of the spar cap of the present invention.

FIG. 8 is a detailed view of the spar tube arrangement of the present invention. Initially it can be seen that the outer wall 22 of pontoon 14 includes an opening 500. Opening 500 is bevelled inwardly at a rakish angle. Opening 500 is formed into the wall 22 of pontoon 14 during the molding of the pontoon. The tubular opening 200 extends through the width of the pontoon 14 and matches the opening through the width of the pontoon 12. The spar tube 202 is a steel rod that is fitted through the opening 200 so as to join the pontoons 12 and 14 together. Spar cap 502 is attached by threads 504 to the end of spar tube 202. The tightening of the cap 502 causes the pontoons 12 and 14 to be joined in a tight fashion. There are plurality of the spar tubes 202 extending through the raft 10 so as to provide a secure and stable raft 10.

The present invention offers significant advantages over presently existing rafts. Initially, because of the catamaran design of the river raft 10 of the present invention, the raft will move through the water at a greater rate. In addition, greater stability is achieved because of this catamaran configuration. The rigidity of the walls of the pontoons will resist damage and will extend the life of the raft through many commercial operations. In addition, the slippery surface of the pontoons allows the raft to be moved through slow water at a faster rate by the oarsman. The use of the elevated central portion eliminates the problems of injuries to the passengers caused by abutting rocks or other objects in the water.

The configuration of the interior of the pontoons of the present invention maximizes the amount of storage available to the commercial river runner. Additionally, since the ice chests and water coolers are provided with receding indentations, the capacity of the raft is further enhanced. The use of the stylized saddles provides the passenger with an enjoyable ride with maximum safety.

Because of the plastic used in the manufacture of the present invention, the method of manufacture, and the configuration of the present invention, the raft 10 of the present invention may be manufactured at a lower cost than conventional rafts used by commercial river runners.

The foregoing disclosure and description of the invention is illustrative and explanatory thereof, and various changes in the size, shape, and materials, as well as in the details of the illustrated construction, may be made within the scope of the appended claims without departing from the true spirit of the invention. This invention should only be limited by the appended claims and their legal equivalents.

I claim:

1. A river raft comprising:

a first solid pontoon having a hollow interior, said first solid pontoon having a forward end and a rearward end, said forward end and said rearward end being symmetrical with each other;

a second solid pontoon having a hollow interior, said second pontoon connected to said first pontoon so as to define a central portion between said first and second pontoons, said central portion having a depth of less than that of said first and second pontoons, said first pontoon and said second pontoon being of symmetrical configuration, said first and second pontoons comprising:

hatch means formed in said first and second pontoons so as to provide access to said hollow interior of said first and second pontoons, said hatch means being detachably mounted to the upper surface of each of said pontoons, said hatch means mounted in water-tight relation to said first and second pontoons, said hatch means comprising:

a seat hatch detachably mounted to one of said first and second pontoons, said seat hatch comprising a saddle extending upwardly for permitting persons to sit thereon; and spar tube means extending through the width of said first and second pontoons, said spar tube means connecting said first and second pontoons.

2. The raft of claim 1, said saddle of said seat hatch having a removable cover for permitting access to the interior of said saddle, said seat hatch being reversible such that said saddle is received by said hollow interior of one of said first and second pontoons.

3. The raft of claim 1, said hatch means comprising:

an oar stand hatch mounted to one of said first and second pontoons, said oar stand hatch having an oar stand fixedly attached thereto, said oar stand for receiving an oar, said oar stand hatch being reversible such that said oar stand is received by said hollow interior of one of said first and second pontoons.

4. A river raft comprising:

a first solid pontoon having a hollow interior, said first solid pontoon having a forward end and a rearward end, said forward end and said rearward end being symmetrical with each other;

a second solid pontoon having a hollow interior, said second pontoon connected to said first pontoon so as to define a central portion between said first and second pontoons, said central portion having a depth of less than that of said first and second pontoons, said first pontoon and said second pontoon being of symmetrical configuration; and spar tube means extending through the width of said first and second pontoons, said spar tube means connecting said first and second pontoons, said spar tube means comprising:

a tubular opening molded through the body of said first and second pontoons, said tubular opening in alignment across said first and second pontoons;

a spar tube extending through said tubular opening, said spar tube being a rigid member having a diameter generally matching the inner diameter of said tubular opening, and a spar cap threadedly connected to said spar tube, said spar cap for maintaining said first and second pontoons in juxtaposition to each other.

5. The raft of claim 1, said first and second pontoons comprised of a roto-molded plastic material.

6. The raft of claim 5, said first and second pontoons comprising:

an outer layer of a solid dense plastic material;

a middle layer of a foamed plastic material having less density than said outer layer; and an inner layer of said solid dense plastic material, said middle layer integrally interposed between said outer layer and said inner layer.

7. A river raft comprising:

a first solid pontoon having a hollow interior, said first solid pontoon having a forward end and a rearward end, said forward end and said rearward end being symmetrical with each other;

a second solid pontoon having a hollow interior, said second pontoon connected to said first pontoon so as to define a central portion between said first and second pontoons, said central portion having a depth of less than that of said first and second pontoons, said central portion having a bevelled opening extending through the depth of said central portion, said bevelled opening narrowing at the bottom of said central portion, said bevelled opening having a generally rectangular shape, said first pontoon and said second pontoon being of symmetrical configuration; and spar tube means extending through the width of said first and second pontoons, said spar tube means connecting said first and second pontoons.

8. A river raft comprising:

a first solid pontoon having a hollow interior; and a second solid pontoon having a hollow interior, said second pontoon connected to said first pontoon in a manner so as to define a central portion between said first and second pontoons, said central portion having a depth of less than that of said first and second pontoons, said central portion having a middle circular indentation extending into the top surface of said central portion, a second circular indentation concentric with and of lesser diameter than said middle circular indentation, and a third circular opening of lesser diameter than said second circular indentation, said third circular opening opening to the bottom of said central portion.

9. The raft of claim 7, said central portion having a pair of foot indentations formed therein, said foot indentations formed in the middle of said central portion.

10. The raft of claim 9, said foot indentations being bevelled at the ends at a twenty degree angle from the vertical, said foot indentations each including a drain hole opening to the bottom of said central portion.

11. The raft of claim 7, said central portion having a plurality of tie-down openings formed in the top surface of said central portion, said tie-down openings being bevelled such that the narrow portion of said opening is adjacent to top surface of said central portion.

12. A river raft comprising:

a first solid pontoon having a hollow interior, said first solid pontoon having a forward end and a rearward end, said forward end and said rearward end being symmetrical with each other;

a second solid pontoon having a hollow interior, said second pontoon connected to said first pontoon so as to define a central portion between said first and second pontoons, said central portion having a depth of less than that of said first and second pontoons, said central portion having a cross-hatched end section and a cross-hatched forward section, said end and forward sections for the receipt of a trampoline, said first pontoon and said second pontoon being of symmetrical configuration; and spar tube means extending through the width of said first and second pontoons, said spar tube means connecting said first and second pontoons.

13. The raft of claim 12, further comprising:

a spray deflector integrally formed with said first and second pontoons, said spray deflector extending around the periphery of said first and second pontoons.

14. The raft of claim 13, said spray deflectors having a plurality of hand grip openings extending therethrough.

15. The raft of claim 7, said bevelled opening having an ice chest fitted therein, the bottom of said ice chest being exposed to the bottom of said central portion.

* * * * *